US007896971B2

(12) United States Patent
Molter

(10) Patent No.: US 7,896,971 B2
(45) Date of Patent: Mar. 1, 2011

(54) METHODS FOR REMOVING CONCRETE ACCRETIONS FROM MIXING DRUM

(75) Inventor: Alan E. Molter, LeSueur, MN (US)

(73) Assignee: HammerRock, Inc., Le Sueur, MN (US)

( * ) Notice: Subject to any disclaimer, the term of this patent is extended or adjusted under 35 U.S.C. 154(b) by 43 days.

(21) Appl. No.: 12/476,710

(22) Filed: Jun. 2, 2009

(65) Prior Publication Data

US 2009/0235953 A1 Sep. 24, 2009

Related U.S. Application Data

(63) Continuation of application No. 11/110,003, filed on Apr. 20, 2005, now abandoned.

(60) Provisional application No. 60/564,634, filed on Apr. 22, 2004.

(51) Int. Cl.
*B08B 9/087* (2006.01)

(52) U.S. Cl. ..... 134/8; 134/22.1; 134/42

(58) Field of Classification Search ..... 134/8, 22.1, 134/42; 15/93.2, 104.096, 246.5
See application file for complete search history.

(56) References Cited

U.S. PATENT DOCUMENTS

| | | | | |
|---|---|---|---|---|
| 3,090,983 | A | 5/1963 | Modrak et al. | |
| 3,287,066 | A | 11/1966 | Billings | |
| 3,346,300 | A | 10/1967 | Grant | |
| 3,381,762 | A | 5/1968 | Lewis et al. | |
| 3,458,396 | A | 7/1969 | Grant | |
| 3,471,888 | A | 10/1969 | Grant et al. | |
| 3,682,253 | A | 8/1972 | McIntosh et al. | |
| 3,746,104 | A | 7/1973 | McIntosh et al. | |
| 3,774,698 | A | 11/1973 | Mosley | |
| 3,995,344 | A | 12/1976 | Meyers | |
| 4,095,306 | A | 6/1978 | Norton | |
| 4,243,107 | A | 1/1981 | Shook | |
| 5,179,757 | A | 1/1993 | Grant, Jr. | |
| 6,418,948 | B1 * | 7/2002 | Harmon | 134/168 R |

* cited by examiner

*Primary Examiner* — Michael Barr
*Assistant Examiner* — Saeed T Chaudhry
(74) *Attorney, Agent, or Firm* — Leffert Jay & Polglaze, P.A.

(57) ABSTRACT

Methods for removing accretions of cured concrete from within a mixing drum are herein disclosed. One method includes an inserting impact tool mounted upon a boom into the interior of the mixing drum, addressing a bit of the impact tool to an accretion adhered to the inner surface of the mixing drum, and actuating the impact tool to apply a force to the accretions through the bit so as to remove the accretion from the interior surface of the mixing drum.

11 Claims, 8 Drawing Sheets

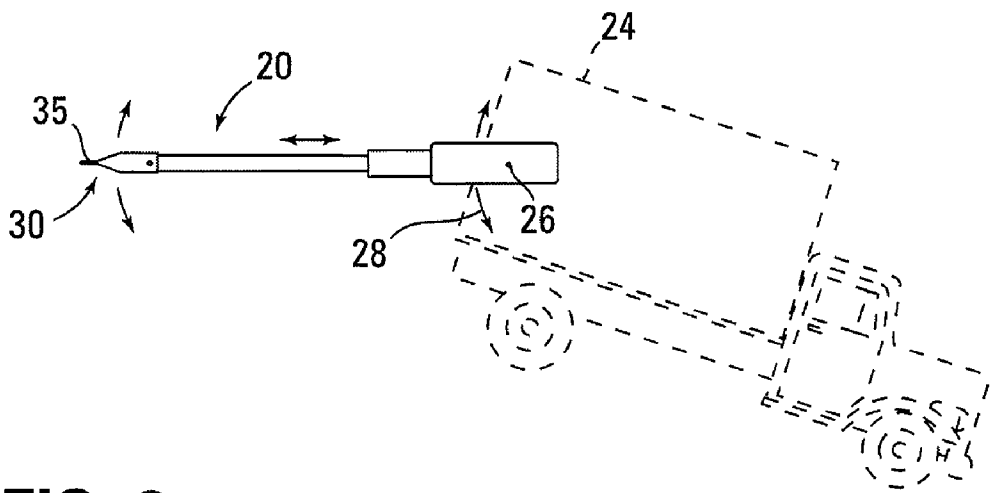
FIG. 2
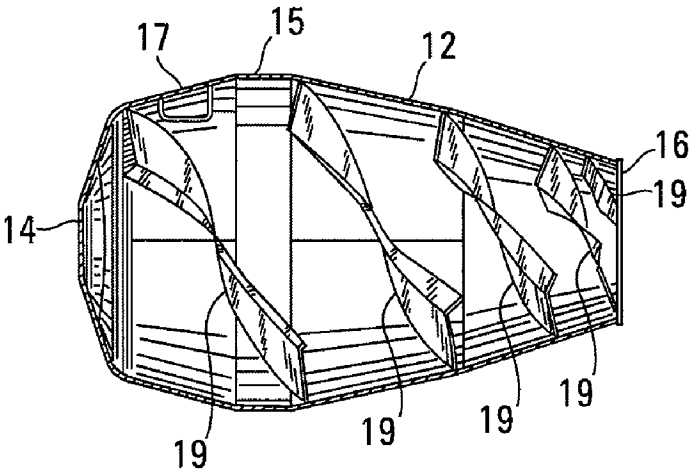

METHODS FOR REMOVING CONCRETE ACCRETIONS FROM MIXING DRUM

RELATED APPLICATIONS

This application claims the benefit of U.S. Provisional Application No. 60/564,634, filed on Apr. 22, 2004, and is a continuation of U.S. application Ser. No. 11/110,003, filed Apr. 20, 2005, now abandoned, which are hereby incorporated herein in their entireties by reference.

FIELD

The present invention relates to an articulating impact mechanism used to remove concrete accretions from the interior of mixing drums. More particularly, the present invention relates to an impact hammer mounted upon an extendable boom, the impact hammer being mounted so as to be able to remove accretions from substantially the entire interior of the mixing drum.

BACKGROUND

At present the only cost-effective way of removing concrete accretions from within a mixing drum involves manually removing the accretions using sledgehammers and pneumatic hammers and chippers. This operation is not only expensive in terms of man-hours expended, but is also highly dangerous in that the noise generated in removing accretions from the interior of a mixing drum is horrendous, the fins mounted within a mixing drum can be sharp and therefore dangerous, the air-quality with in the mixing drum is bad due to the dust generated, and the likelihood of accident with the tools used to remove the accretions is relatively high.

Numerous methods have been suggested to remove accretions from within mixing drums. One such method involves rapidly striking the exterior of a mixing drum in order to loosen accretions within the drum. Not only does this method risk damaging the drum itself, but also many accretions may not be loosened by this method and manual removal of the remaining accretions will still be required. Another mechanism applies microwaves to the accretions within the mixing drum in hopes that heating the residual water within the accretions will cause the accretions to breakup. While the use of microwaves does remove at least some of the problematic accretions, the application of microwaves is of limited effectiveness and is also prohibitively expensive.

Other devices include mechanisms that mount an impact hammer thereon for the purpose of removing accretions from the interior of a silo, for removing the firebrick from the interior of a metal pouring crucible, and for chipping away at the surface of the rock in a mine. None of these devices have the necessary articulation that would allow them to reach all of the interior surfaces of a mixing drum having mixing fins mounted therein. While the crucibles used in steel making operations are roughly the same size and shape as a concrete mixing drum, concrete mixing drums include mixing fins on their interior, thereby creating a complex shape around which the tool must navigate. Concrete mixing fins are generally helical in shape and extend inwardly away from the inner surface of the mixing drums. Concrete accretions that form on or around these fins are difficult to access for the types of prior art devices described hereinabove, which are designed to access relatively uncluttered surfaces.

Accordingly, it is an object of the present invention to provide a device for removing accretions from within a mixing drum that has an impact tool that can be arranged to access substantially the entire interior of the drum having mixing fins mounted therein. Furthermore, it is an object of the present invention to provide a device that may readily be used with mixing drums of various designs without modification. Another object of the present invention is to provide a device that can readily be brought to a remote location to remove accretions from a mixing drum or which may be mounted permanently in a single location for the purpose of removing accretions from a mixing drum.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DESCRIPTION OF THE DRAWINGS

FIG. 2 is a cross-section of a mixing drum showing one embodiment of an accretion removing device in relation thereto;

Figure 1:
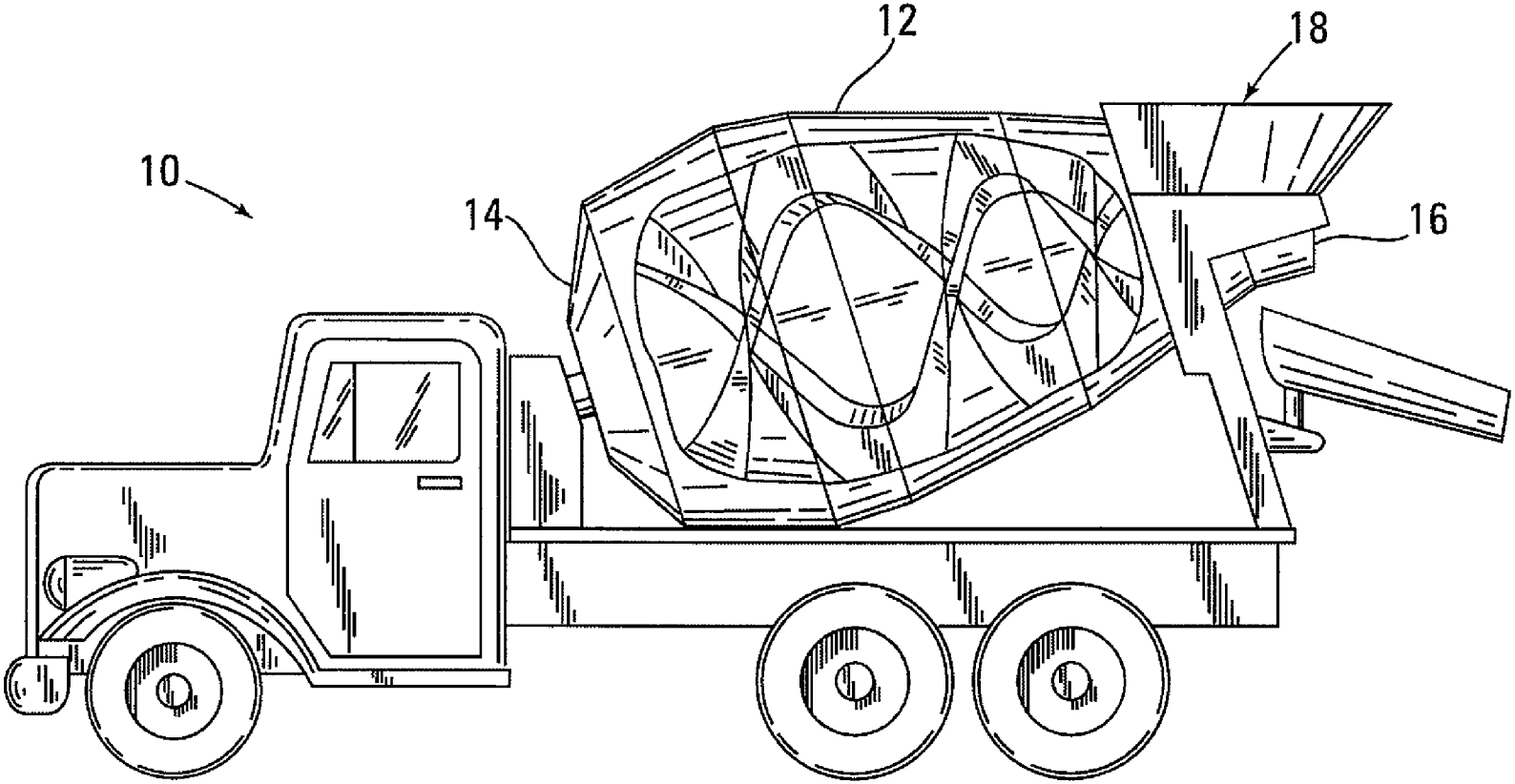
FIG. 1 Prior Art
FIG. 1 is a partially cutaway side view of a prior art concrete mixing truck having a mixing drum mounted thereon.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top," "bottom," "upper," "lower," "first,"

"second," "inside," "outside," and similar terms are used herein, it should be understood that these terms have reference only to the structure shown in the drawings as it would appear to a person viewing the drawings and are utilized only to facilitate describing the invention.

DETAILED DESCRIPTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

Turning first to FIG. 1, there is illustrated a typical prior art concrete mixing truck 10 having a mixing drum 12 mounted thereon. Note that the mixing drum 12 is mounted upon the truck 10 at an angle such that its closed end 14 is lower than its open end 16. Ingredients for concrete are deposited in the drum 12, and mixed concrete is removed therefrom, through the open end 16 by means of a series of funnels and troughs 18. Note also that the truck 10 illustrated in FIG. 1 is of a variety in which the mixing drum is 12 is arranged such that the open end 16 thereof is located at the rear of the truck 10. The present invention may be used with this type of truck 10 or with another variety of truck (not shown) in which the mixing drum 12 is reversed such that the open end 16 of the drum 12 faces forward upon the truck 10. The present invention may also be used to remove accretions from mixing drums 12 that are mounted in a fixed location, such as the batch drums (not shown) commonly used in a concrete plant.

FIG. 2 illustrates a typical mixing drum 12 and how the accretion-removing device 20 of the present invention is addressed thereto. As can be seen, the drum 12 has a closed end 14 and open end 16. The drum 12 is angled such that ingredients to be mixed within the drum 12 will congregate closer to the central bulge 15 of the drum 12 nearer the closed end 14 thereof. The drum 12 is also provided with a hatch or manway 17 that allows access to the interior of the drum without having to enter through the open end 16 of the drum 12. The drum 12 is also provided with a number of fins 19 that are generally helical in arrangement. The fins 19 are further arranged so as to create a shear forces within the admixture deposited within the mixing drum 12. These shear forces aid in mixing the concrete and act to selectively retain and remove the mixed concrete in and from the drum 12, depending on the direction in which the drum 12 is rotated.

Over time, small quantities of concrete cure within the drum 12 and adhere to the inner walls and fins 19 thereof. Eventually, these accretions will begin to severely limit the performance of the mixing drum 12 as the drum 12 will become much heavier and the effectiveness of the fins in mixing the concrete within the drum 12 will be reduced. The greater weight of the drum 12 will increase the wear and tear on the drum 12 and truck 10 and the increased friction present within the drum 12 due to the accretions will negatively affect the mixing action of the drum 12 as well. Where a concrete mixing truck 10 is involved in an accident or the mechanism whereby the mixing drum 12 is rotated otherwise becomes inoperable, all or a significant portion of the cement within the mixing drum 12 may harden, thereby rendering the drum 12 entirely unusable. The abrasive nature of concrete being what it is, mixing drums 12 do have a limited life. However, the useful life of a mixing drum is long enough that accretions of concrete will build up to unacceptable levels long before the drum 12 must be replaced. Accordingly, it will be necessary to remove these accretions multiple times over the life of a particular mixing drum 12.

As can be seen in FIG. 2, the accretion removing device 20 of the present invention may be inserted into the interior of the mixing drum 12 such that the striking tool 30 of the device 20 may be addressed to the accretions of concrete that are adhered to the inner surface of the drum 12 and to the fins 19. In order to insert the device 20 into the drum 12, there must be relative motion between the drum 12 and the device 20. In one embodiment of the present invention, the device 20 is mounted upon a mobile platform such as a truck 24. In this embodiment, the device 20 will be inserted into the drum 12 by backing the truck 24 up to the drum 12. The device 20 will be mounted or positioned at a sufficient height with respect to the open end 16 of the drum 12 so as to allow the device 20 to be inserted through the open and 16 of the drum 12. Note also that the device 20 must be rotatable about axis 26 as shown by arrows 28 so as to match the angle of the drum 12. It is likely that the device 20 will be rotated about the axis 26 as the truck 24 backs up to the drum 12 so that the angle of the device 20 with respect to the drum 12 may be continuously corrected so as to avoid striking the interior drum 12 or fins 19 with the device 20.

Another embodiment of the device 20 may be mounted upon a fixed platform (see FIG. 8) so that a concrete mixing truck 10 may be addressed to the stationary device 20. Again, the device 20 will be rotated as the concrete mixing truck 10 is moved towards the device 20 so as to match the angle of the device 20 with the angle of the drum 12. In this embodiment of the device 20, the device 20 may be mounted upon a fixed platform that is mounted upon the floor or upon a support that is mounted on an overhead structure suspended above the drum 12 (not shown).

Figure 3:
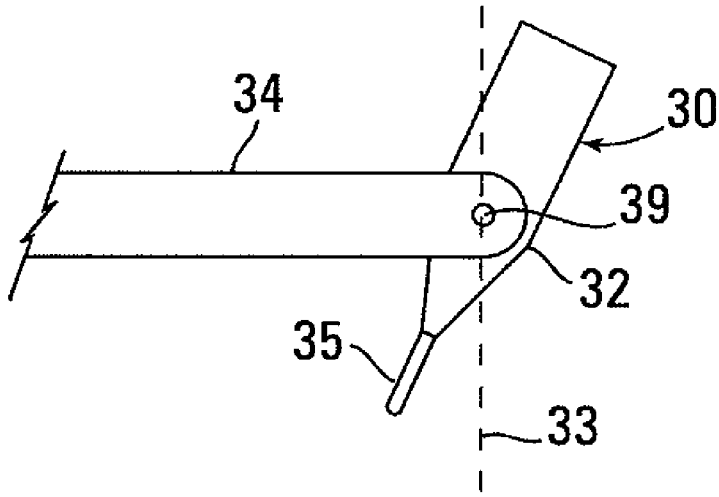
FIG. 3 is a schematic view of one embodiment of an impact tool of the accretion removing device of the present invention.

FIG. 3 is a close-up schematic view of the impact tool 30 of the device 20. The chassis 32 of the impact tool 30 is mounted upon a boom 34 of the device 20. In one embodiment, the boom 34 will be arranged so as to allow the chassis 32 of the impact tool 30 to rotate approximately 270° about axle 39. In one embodiment, this rotation is generally symmetric with respect the axis 40 (shown in FIG. 5) of the boom 34. This range of motion can easily be accomplished by constructing at least the end of the boom 34 of two parallel plates that allow the chassis 32 to rotate therebetween. In another embodiment of the present invention, the impact tool 30 will rotate through approximately 180° on axle 39, the rotation being generally symmetric about axis 33.

Figure 4:
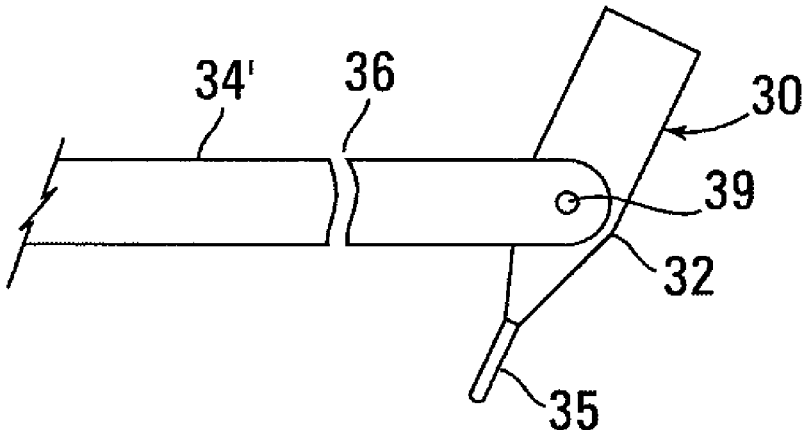
FIG. 4 is another embodiment of the device as shown in FIG. 3 that includes a rotating wrist joint.

FIG. 4 illustrates another embodiment of the device 20 that further includes a "wrist" joint 36. The a wrist joint 36 allows for rotation of the tool 30 about an axis defined by the length of the boom 34'. In one embodiment, the wrist joint 36 will enable the tool 30 to rotate at least 360° about the axis defined by the boom 34'. In yet another embodiment, the wrist joint 36 will enable the tool 30 to rotate up to 380° about the boom 34'.

Figure 5:
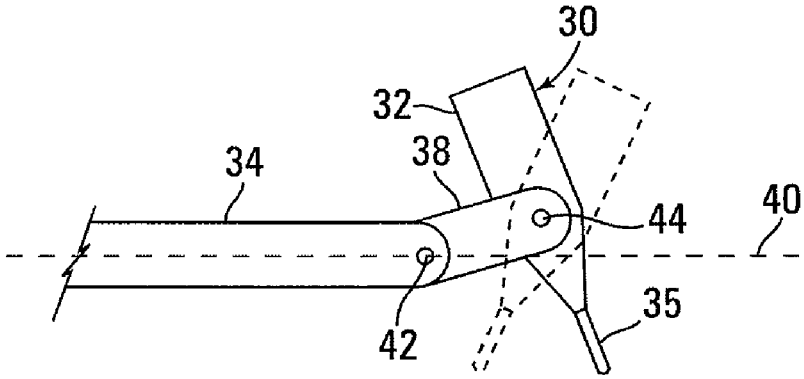
FIG. 5 is another embodiment of the device as shown in FIG. 3 that includes a rotating arm coupled between a boom and an impact tool of the device.

FIG. 5 illustrates yet another embodiment of the device 20 in which a rotatable arm 38 is interposed between the boom 34 and a tool 30. The arm 38 allows for more flexible positioning of the bit 35 of the tool 30, thereby increasing the effectiveness of the device 20. In some applications, it may be necessary to be able to position the bit 30 such that it may attack accretions that are located at or near an axis 40 of the boom 34. Note that the arm 38 is pinned to the boom 34 by an axle 42 or equivalent structure. Arm 38 may rotate with respect to boom 34 about the axle 42 and is actuated by a typical hydraulic or pneumatic actuator (not shown). Similarly, the tool 30 is joined to the arm 38 by axle 44 or equivalent structure. Tool 30 is free to rotate about axle 44 as described hereinabove. Note that the arm 38 may also be employed in conjunction with a wrist joint 36 such as the illustrated in FIG. 4.

Figure 6:
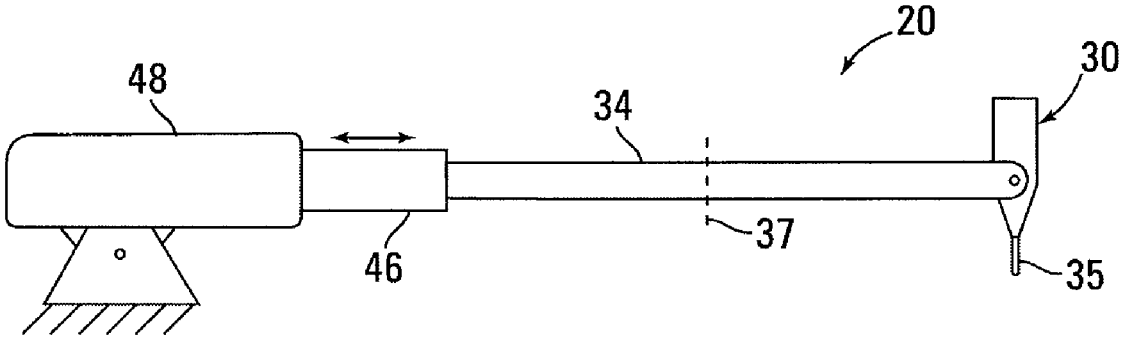
FIG. 6 is a schematic side view of an embodiment of the accretion removing device showing the impact tool coupled to an elongate boom.

FIG. 6 illustrates one embodiment of the present invention in which the tool 30 is mounted upon an elongate boom 34. The elongate boom 34 is in turn coupled to an extendable arm 46 that is itself received within a tube 48. Note that tube 48 and extendable arm 46 are adapted to support and manipulate the boom 34. In one such embodiment, the extendable arm 46 and the tube 48 are part of a specially adapted hydraulic excavator of a type marketed by the Badger Equipment Co. of Winona, Minn. as a Series 460 HYDRO-SCOPIC™ hydraulic excavator. Note that a wrist joint 36 may be incorporated into the boom 34, or into the extendable arm 46. The embodiment illustrated in FIG. 6 may be mounted upon a truck or other mobile platform such as a gantry crane or a wheel or tracked carriage; this embodiment may also be fixed in its location, being mounted upon a turntable that is itself secured to a concrete support or the like.

Where the device 20 is adapted to be brought to a mixing drum 12 for operation, the boom 34 may be too long for easy transport upon the roads. Accordingly, dismounting the boom 34 entirely from the device 20 may facilitate transport of the device 20. Alternatively, the boom 34 may be provided with a hinge 37. In this embodiment, the boom 34 may be folded upon itself so that the device 20 may be transported in compliance with state Department of Transportation rules.

Figure 9:
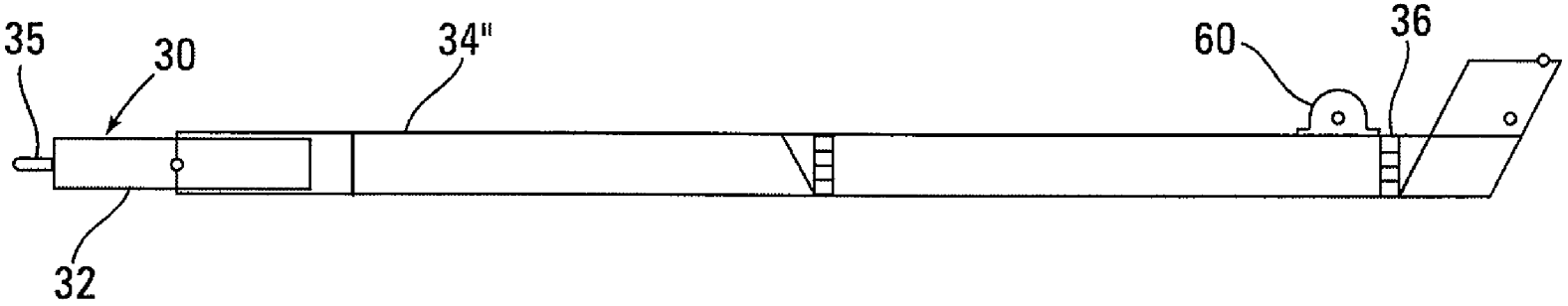
FIG. 9 is a schematic, side view of another embodiment of the accretion removing device having an elongate, rotating boom; and, FIG. 10 is a schematic side view of the embodiment of FIG. 9 showing the opposing side of the accretion-removing device of the present invention.
Figure 10:
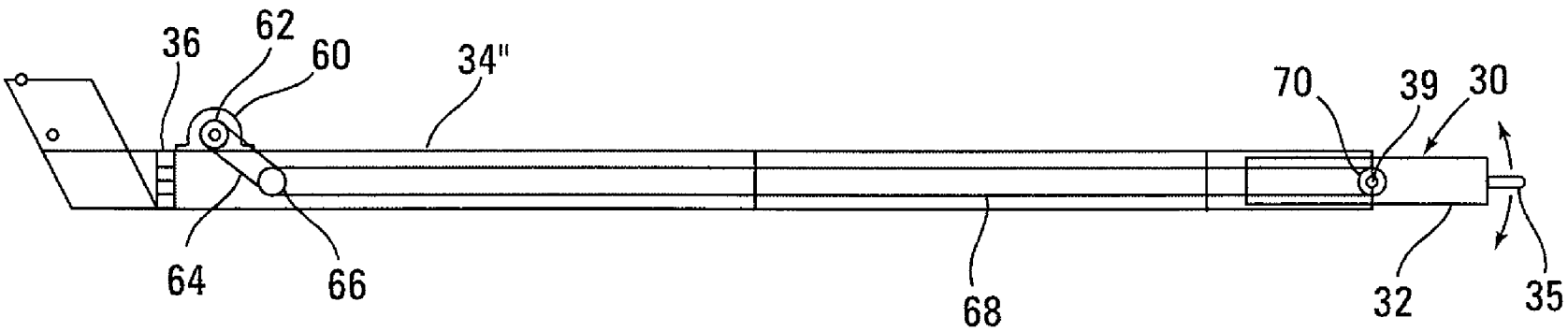

In yet another embodiment, the boom 34 may be omitted in favor of an elongate extendable arm 46. FIGS. 9 and 10 illustrate another embodiment of the present invention in which the boom 34" has a wrist joint 36 at its base end.

Figure 12:
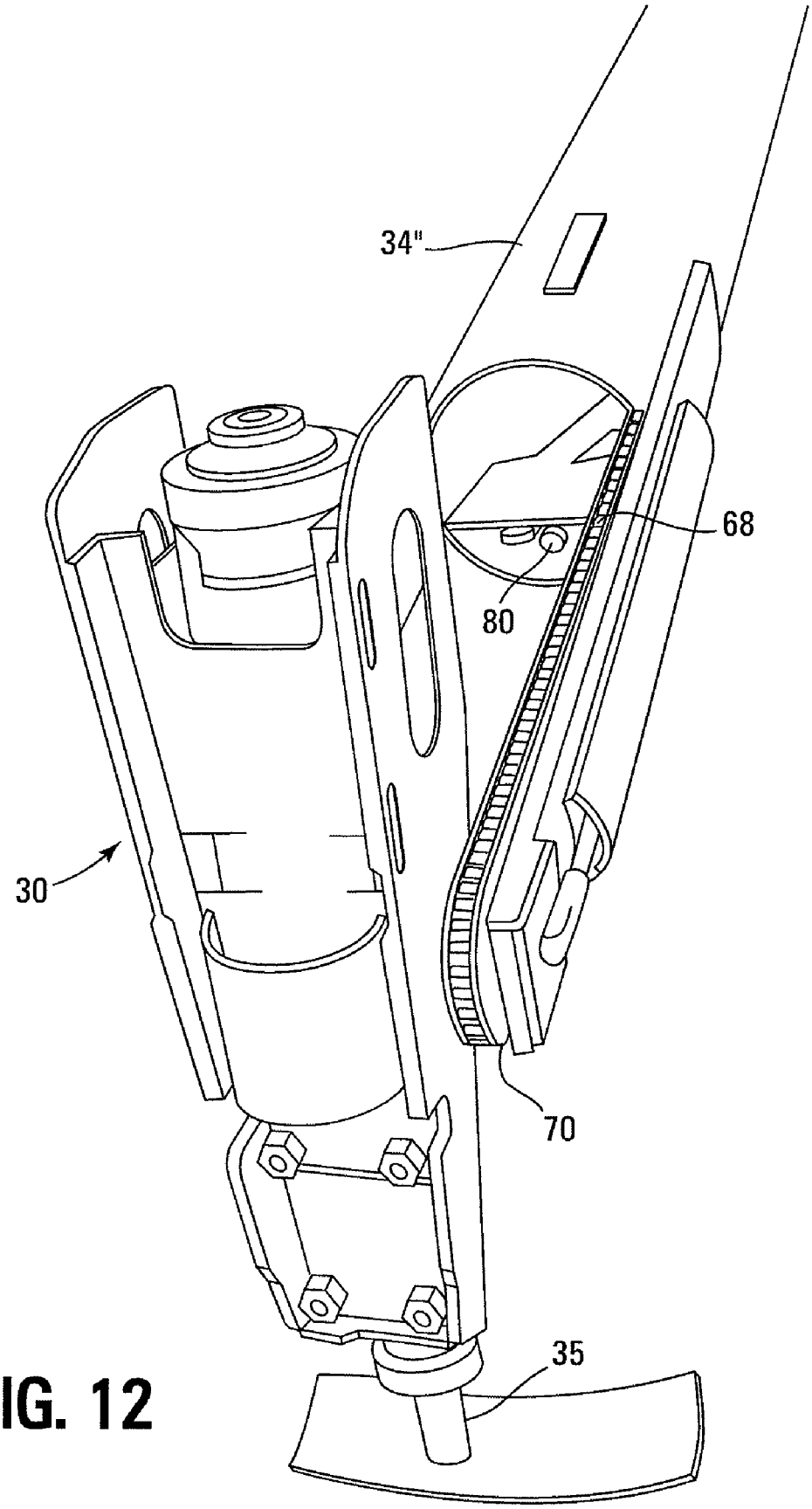
FIG. 12 is a close-up, perspective view of the tool of the accretion removing device.

FIGS. 10 and 12 illustrate one embodiment for rotating the tool 30 about axis 39. A rotary actuator 60 mounted on boom 34" has a sprocket or sheave 62 mounted thereon. A chain or belt 64, as the case may be, is passed around sprocket 62 and through an opening in the tubular boom 34". The chain 62 is then passed around a second sprocket 66 that is located within the boom 34". In one embodiment, sprocket 66 is a double sprocket, i.e. has two sprockets mounted side by side on the same axle and constrained to rotate with one another. A second chain 68 is passed around sprocket 66 and extends through boom 34" to a third sprocket 70 mounted on axle 39 of tool 30 as can best be seen in FIG. 12. Rotation of the rotary actuator 60 is accordingly transferred by chains 64 and 68 to tool 30.

Figure 7:
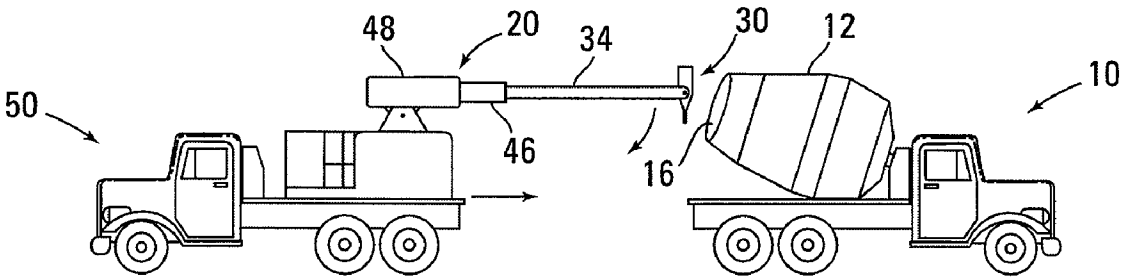
FIG. 7 is a schematic representation of one embodiment of the device mounted upon a vehicle, the device being addressed to a mixing drum mounted upon a concrete mixing truck.
Figure 8:
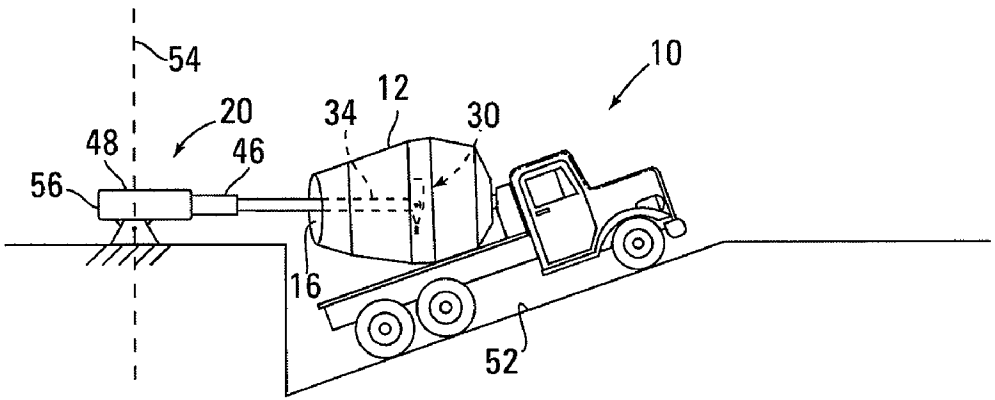
FIG. 8 is a schematic representation of one embodiment of the device mounted upon a fixed stand, the impact tool of the device being addressed to the interior of a mixing drum mounted upon a concrete mixing truck that is positioned upon inclined surface.

Referring next to FIGS. 7 and 8, in operation, a preferred embodiment of the device 20 mounted upon a vehicle 50 may be addressed to the interior of a mixing drum 12 mounted upon a concrete mixing truck 10 by moving the vehicle 50 adjacent to the drum 12. The device 20 is manipulated so that the tool 30 passes into the open end 16 of the drum 12. Note that as the vehicle 50 is moved closer to the drum 12, the boom 34 will likely need to be manipulated to prevent the tool 30 from striking the interior of the drum 12.

Where the boom 34 has been omitted in favor of an extendable arm 46 having a travel length sufficient to address the tool 30 to the entire length of the interior of the drum 12, the vehicle 50 will be positioned securely before the tool 30 is inserted into the mixing drum 12. Note that in some circumstances it may be preferable to move the vehicle 50 with respect to the concrete mixing truck and that in other circumstances it may be preferable to move the concrete mixing truck 12 with respect to the vehicle 50. However, where the length of travel of the extendable arm 46 or a similar structure upon which the tool 30 is mounted is not such that the tool 30 may be addressed to the entire length of the drum 12, it will likely be necessary for the entire device 20 and drum 12 to move with respect to one another whether by moving the truck 10, vehicle 50, or, as indicated above, moving the device 20 itself with respect to the drum 12.

In some embodiments, the device 20 is mounted at a height that is sufficient to allow the boom 34 and hence the tool 30 to be inserted into the interior of the drum 12 as described in conjunction with FIG. 7. However, where it is more economical to mount the device 20 lower to the ground, or where the vehicle 50 upon which the device 20 is mounted is significantly lower than the open end 16 of the drum 12, it may be necessary to position the concrete mixing truck 10 at an angle with respect to the device 20. In one embodiment, the device 20 may be installed in a fixed position adjacent to a sunken ramp 52. The concrete mixing truck 10 is then positioned on the ramp 52 such that the boom 34 may be inserted into the interior of the drum 12 through open end 16. Preferably, all embodiments of the device 20 will be mounted in such a way that the boom 34 upon which is mounted the tool 30 has at least three degrees of freedom; specifically, the booms 34, 34', and 34" may be rotated about a vertical axis such as that described by axis 54, it may be raised and lowered as by rotation about pivot point 56, and it may be extended and retracted along an axis defined by the extendable arm 46. Depending on how the device 20 is mounted, and upon whether it includes a rotatable arm 38 and/or a wrist joint 36, it is possible that the boom 34 may be mounted in a fixed position such that the boom 34 does not move at all. Alternatively, the boom 34 may be extended, retracted, and rotated about a vertical axis, or may be moved up and down by rotation or any combination of these three modes of travel.

In another embodiment of the device 20, the boom 34" is coupled to arm 46 by a coupling 100. Coupling 100 includes a mounting post 102 that is secured by means of bolts 104 to the arm 46. Bearing blocks 106 are mounted in an upper surface of the mounting post 104 and receive therein a shaft 108 of an upright 110. Upright 110, being coupled to mounting post 104 by bearings 106, will rotate around an axis defined by shaft 108 and bearings 106.

Figure 11:
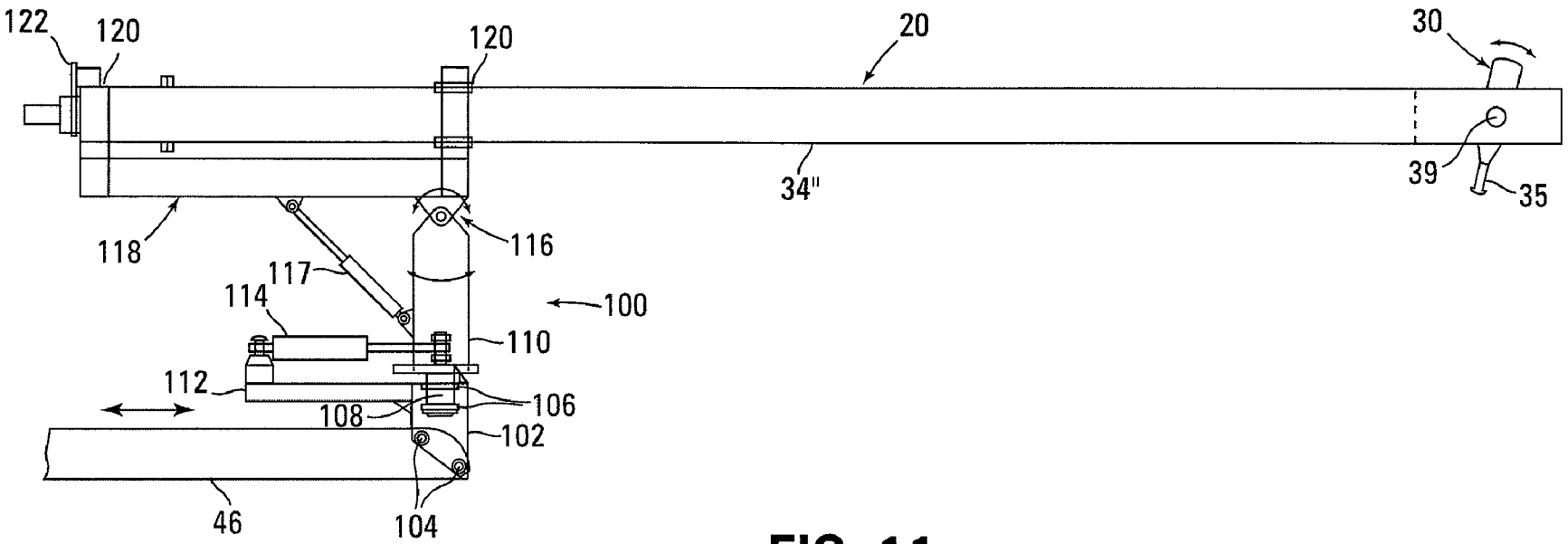
FIG. 11 is a side elevation of another embodiment of the device wherein the boom is mounted to an extendable arm.

Arm 112 is coupled to and extends from mounting post 102. Arm 112 is constructed such that a linear hydraulic or pneumatic cylinder 114 coupled between a distal end of the arm 112 and a tangential surface of the upright 110, will rotate the upright 110 within bearings 106 to provide lateral adjustment of the boom 34". What is more, the arm 112 and cylinder 114 may be adapted to rotate the boom 34" into a stowed position in which the boom 34" is essentially rotated into a position that is more or less a mirror image of the position of the boom 34" as seen in FIG. 11. Boom 34" is held in a cradle 118 that is rotatively coupled by pin joint 116 to upright 110. Hydraulic or pneumatic cylinder 117 is coupled between the upright 110 and the cradle 118 to rotate the cradle 118 with respect to the upright 110 about pin joint 116.

The boom 34" is coupled to the cradle 118 by rotary bearings 120 such that boom 34" may be rotated about its longitudinal axis. A rotary actuator 122 coupled between the cradle 118 and the boom 34" rotates the boom 34" with respect to the cradle 118.

In some embodiments, the mounting post 102, arm 112, and cylinder 112 are omitted in favor of rotatively pinning the bottom end of the upright 110 directly to the arm 46. In these embodiments, the lateral adjustment of the boom 34" is accomplished by adjusting the lateral position of the arm 46.

Where the device 20 is mounted upon a vehicle 50 having a low height, and where no ramp 52 is available, it may be possible to position the front or rear wheels of the concrete mixing truck 10, depending upon the orientation of the drum 12, upon a portable ramp (not shown) such that the angle of the drum 12 in the position of the open end 16 thereof may allow the entry of the device 20 into the interior of the drum 12.

The tool 30 is preferably an impact tool operated by means of hydraulic or pneumatic pressure. Such tools are well known in the art and are commonly used in the construction and mining fields. The tool 30 includes a bit 33 the may be addressed to accretions of concrete deposit on the interior of the drum 12. It is preferable to utilize a bit 33 that is somewhat blunt as a sharp bit 33 may accidentally puncture the walls of the drum 12. This is particularly problematic in older drums 12 in which the abrasive nature of the concrete mixed therein has significantly eroded the metal walls of the drum 12.

The mechanism whereby the boom 34 may be extended, rotated laterally, and rotated vertically, is preferably a hydraulic mechanism, though it is to be understood that pneumatic, electrically actuated, or manually operated mechanisms may be used as well. Such mechanisms are well known in the art and are commonly in use in construction and mining fields.

In operation, it is desirable for an operator of the device 20 to visually inspect the removal of the accretions as work proceeds. In one embodiment of the device 20, the operator of the device 20 is located remotely with respect to the vehicle 50 upon which the device 20 is mounted. The operator manually manipulates the controls that actuate the device 20. The operator views the work as it progresses using a closed circuit television camera 80 and monitor (not shown). Alternatively, the operator may be provided with remote controls and may view the progress of the device 20 through the manway 17 or through the open end 16 of the drum 12. It is also envisioned that an electronic controller (not shown) may be programmed with the geometry of a given mixing drum 12. The electronic controller, using the programmed geometry information, is able to automatically remove the accretions from the drum 12 on the basis of a predetermined set of instructions.

In addition to video monitoring, other sensors may be utilized to accurately determine the position of the tool 30 and bit 33. These may include, but are not limited to laser range finders, optical sensors, gyroscopes, linear and rotary encoders, and the like.

In addition to removing accretions that accumulate on the interior surfaces of the mixing drum 12, the device 20 may be utilized to remove large, solid masses of cured concrete from a mixing drum 12 where an accident or malfunction has allowed the concrete within the mixing drum 12 to cure.

It is envisioned that a single vehicle 50 having a device 20 mounted thereon may be used to service the large number of concrete mixing trucks 10 over a large area. In this way, no single cement company or contractor will be required to purchase, operate, and maintain the device 20. Alternatively, where it is economically feasible, the operator of one or more concrete mixing trucks 10 or the operator of a cement mixing plant, may install a device 20 in a particular fixed location to which the concrete mixing trucks 10 are brought to have accretions removed from their mixing drums 12.

In operation, the device 20 and the mixing drum 12 are first positioned with respect to one another such that the tool 30 may be inserted into the interior of the drum 12. As indicated above, this may involve moving the vehicle 50 upon which the device 20 is mounted toward the concrete mixing truck 10, moving the concrete mixing truck 10 toward the device 20 (regardless of whether the device 20 is mounted upon a vehicle 50 or upon a fixed or semi-fixed platform), or extending an arm 46 so as to inserted the tool 30 into the mixing drum 12.

Once the tool 30 has been inserted into the interior of the mixing drum 12, the tool 30 is manipulated to bring the bit of the tool 30 into contact with the accretions of concrete within the drum 12. The tool 30 is then actuated so that the bit 33 will break up the accretions. Once all of the accretions have been removed from the interior surfaces of the drum 12, or where the loose accretions broken off from the interior of the drum 12 interfere with the ability of the bit 30 to remove more accretions, the device 20 will be removed from the interior of the drum 12 and the loose concrete will be removed therefrom. Loose concrete in the drum 12 may be removed manually or the drum 12 may be rotated to remove them in the same way that uncured, plastic concrete is removed from the drum 12. Alternatively, a vacuum type mechanism (not shown) may be used to remove loose accretions from the drum 12. Where accretions remain adhered to the drum 12, the device 20 may be reinserted into the drum 12 to loosen the remaining accretions.

It is desired to adapt the device 20 so that it may access the entire interior surface of the mixing drum 12 including its fins 19 without requiring the drum 12 to be moved or rotated. However, in some embodiments, the range of motion of the device 20 may be limited such that the device 20 may address only a portion of the drum 12 at any given point in time. For example, the tool 30 may be addressed to a portion of the interior of the drum whereafter the drum 12 is rotated to allowed the tool 30 to address another portion of the drum 12. Similarly, the tool 30 may be positioned longitudinally with in the drum 12 by moving the drum 12 and/or the device 20 with respect to one another.

The bit 33 is preferably fashioned of steel, but may also be fashioned of a relatively hard, resilient material that is sufficiently rigid to break up concrete accretions, but which is resilient enough to somewhat reduce the noise engendered by the bit 33 striking the steel walls of the mixing drum 12 and which will be less likely to pierce the sides of drum 12. Noise created by the activity of removing accretions and interior of a mixing drum 12 may further be damped by carrying out the procedure entirely inside an insulated building or tent, or by placing a material over the exterior of the mixing drum 12 to damp out vibrations.

Since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes that come within the meaning and range of equivalency of the claims are intended to be embraced therein.

What is claimed is:

1. A method of removing accretions of cured concrete from the interior of a mixing drum, comprising:

inserting a boom having an impact tool mounted thereon into the interior of the mixing drum;

addressing a bit of the impact tool to an accretion adhered to the inner surface of the mixing drum; and, actuating the impact tool to apply a force to the accretions through the bit so as to remove the accretion from the interior surface of the mixing drum.

2. The method of removing accretions of cured concrete from the interior of a mixing drum of claim 1, further comprising rotating the impact tool so as to address a preselected portion of the interior of the mixing drum.

3. The method of removing accretions of cured concrete from the interior of a mixing drum of claim 1, further comprising rotating the drum so as to address a preselected portion of the interior of the mixing drum to the impact tool.

4. The method removing accretions of cured concrete from the interior of a mixing drum of claim 1, wherein addressing further comprises rotating the impact tool about an axis that is substantially aligned with the length of the boom.

5. The method of removing accretions of cured concrete from the interior of a mixing drum of claim 1, wherein addressing further comprises rotating the impact tool about an axis that is substantially perpendicular to the boom.

6. The method of removing accretions of cured concrete from the interior of a mixing drum of claim 1, wherein addressing further comprises positioning the impact tool using a positioning mechanism constructed and arranged so as to allow the impact tool to address substantially the entire inner surface of the mixing drum.

7. The method of removing accretions of cured concrete from the interior of a mixing drum of claim 6, wherein addressing further comprises positioning the boom using the positioning mechanism.

8. The method of removing accretions of cured concrete from the interior of a mixing drum of claim 1, and further comprising:

positioning the impact tool of the boom within the interior of the mixing drum so as to maneuver the impact tool around internal fins of the mixing drum such that the bit of the impact tool may transmit the force to the accretions of concrete to the interior surface of the mixing drum and the internal fins of the mixing drum.

9. The method of removing accretions of cured concrete from the interior of a mixing drum of claim 1, and further comprising positioning the impact tool so as to permit the bit to be addressed to respective sides of the two-sided fins of the mixing drum.

10. The method of removing accretions of cured concrete from the interior of a mixing drum of claim 1, wherein the boom is inserted into the interior of a mixing drum in substantial alignment with an axis of rotation of the mixing drum.

11. The method of removing accretions of cured concrete from the interior of a mixing drum of claim 10, wherein the boom is aligned with the axis of rotation of the drum without resorting to inclining a mounting device for the boom or the mixing drum.

* * * * *